US012677878B2

(12) United States Patent
Nelson

(10) Patent No.: US 12,677,878 B2
(45) Date of Patent: Jul. 14, 2026

(54) CONSUMABLE AND AEROSOL PROVISION SYSTEM WITH THERMAL FUSE

(71) Applicant: NICOVENTURES TRADING LIMITED, London (GB)

(72) Inventor: David Alan Nelson, Southampton (GB)

(73) Assignee: NICOVENTURES TRADING LIMITED, London (GB)

( * ) Notice: Subject to any disclaimer, the term of this patent is extended or adjusted under 35 U.S.C. 154(b) by 838 days.

(21) Appl. No.: 17/756,529

(22) PCT Filed: Nov. 17, 2020

(86) PCT No.: PCT/GB2020/052927
§ 371 (c)(1),
(2) Date: May 26, 2022

(87) PCT Pub. No.: WO2021/105650
PCT Pub. Date: Jun. 3, 2021

(65) Prior Publication Data

US 2022/0408813 A1 Dec. 29, 2022

(30) Foreign Application Priority Data

Nov. 29, 2019 (GB) ..... 1917441.6

(51) Int. Cl.
*A24F 40/46* (2020.01)
*A24F 40/10* (2020.01)

(52) U.S. Cl.
CPC ..... *A24F 40/46* (2020.01); *A24F 40/10* (2020.01)

(58) Field of Classification Search
CPC ..... A24F 40/46; A24F 40/10; A24F 40/20
See application file for complete search history.

(56) References Cited

U.S. PATENT DOCUMENTS

| | | | | |
|---|---|---|---|---|
| 10,045,561 | B2 | 8/2018 | Flick | |
| 2014/0283856 | A1 | 9/2014 | Xiang | |
| 2015/0181934 | A1* | 7/2015 | Lyubomirskiy | A24F 40/46 131/329 |
| 2016/0021930 | A1* | 1/2016 | Minskoff | A24F 40/51 392/395 |
| 2016/0198767 | A1 | 7/2016 | Verleur | |
| 2017/0020190 | A1 | 1/2017 | Chang et al. | |
| 2017/0224016 | A1 | 8/2017 | Reevell | |

(Continued)

FOREIGN PATENT DOCUMENTS

| | | |
|---|---|---|
| WO | WO-2017185051 A1 | 10/2017 |
| WO | 2019122876 | 6/2019 |

(Continued)

OTHER PUBLICATIONS

Nicolas Duval, "12 Herbs You Can Vape", Aug. 19, 2018, https://smokableherbs.com/vaping-herbs/ retrieved on Oct. 23, 2024. (Year: 2018).*

(Continued)

*Primary Examiner* — Michael H. Wilson
*Assistant Examiner* — Daniel Edward Vakili
(74) *Attorney, Agent, or Firm* — MERCHANT & GOULD P.C.

(57) ABSTRACT

A consumable for an aerosol provision system including a heater configured in use to supply energy to form an aerosol from an aerosol generating medium, wherein the heater is a thermal fuse.

12 Claims, 3 Drawing Sheets

(56) References Cited

U.S. PATENT DOCUMENTS

| | | | | |
|---|---|---|---|---|
| 2017/0245550 | A1* | 8/2017 | Freelander | A24F 40/50 |
| 2017/0303595 | A1 | 10/2017 | Bernauer et al. | |
| 2018/0020735 | A1 | 1/2018 | Bilat et al. | |
| 2018/0303166 | A1 | 10/2018 | Qiu | |
| 2020/0008467 | A1* | 1/2020 | Ouyang | A24F 40/40 |
| 2020/0113240 | A1* | 4/2020 | Aller | A61M 15/06 |
| 2021/0100291 | A1* | 4/2021 | Sur | G01J 5/10 |
| 2021/0177064 | A1* | 6/2021 | Fisher | A24F 40/57 |

FOREIGN PATENT DOCUMENTS

| | | | | |
|---|---|---|---|---|
| WO | WO-2019137994 | A1 | 7/2019 | |
| WO | WO-2019173923 | A1 * | 9/2019 | A24F 40/42 |

OTHER PUBLICATIONS

Soar, R.N., 50 Simple L.E.D. Circuits, 1977, Babani Press (Year: 1977).*

Sacks, Injury for E-Cigarette Explosion, The New England Journal of Medicine Jun. 20, 2019 (Year: 2019).*

International Preliminary Report on Patentability for Application No. PCT/GB2020/052927, mailed on Feb. 8, 2022, 8 pages.

International Search Report and Written Opinion for Application No. PCT/GB2020/052927, mailed on Feb. 22, 2021, 15 pages.

European Communication Pursuant to Article 94(3) EPC for Application No. 20811085.8, dated Feb. 9, 2026, 7 pages.

* cited by examiner

CONSUMABLE AND AEROSOL PROVISION SYSTEM WITH THERMAL FUSE

PRIORITY CLAIM

The present application is a National Phase entry of PCT Application No. PCT/GB2020/052927, filed Nov. 17, 2020, which claims priority from GB Patent Application No. 1917441.6, filed Nov. 29, 2019, both of which are hereby fully incorporated herein by reference.

TECHNICAL FIELD

The present invention relates to a cartomizer, an aerosol provision system, a method of providing an aerosol, and aerosol provision means.

BACKGROUND

Aerosol provision devices are known. Common devices use heaters to create an aerosol from an aerosol generating medium which is then inhaled by a user. Heaters provide thermal energy to the aerosol generating medium during operation. When the medium is depleted or an error occurs in the use process, the heater can overheat. This can lead to the phenomena "hot puff" and "dry out".

It is desirable for aerosol provision devices to note the operating temperature of the heater and guard against irregular activity in the heating profile. Therefore there is a requirement to provide an improved heating system with capacity to lessen the above effects.

The present invention is directed toward solving some of the above problems.

SUMMARY

Aspects of the invention are defined in the accompanying claims.

In accordance with some embodiments described herein, there is provided a consumable for an aerosol provision system, the consumable comprising: a heater configured in use to supply energy to form an aerosol from an aerosol generating medium, wherein the heater is a thermal fuse.

In accordance with some embodiments described herein, there is provided an aerosol provision system comprising: an aerosol generating medium; and, a heater, the heater configured in use to supply energy to form an aerosol from the aerosol generating medium and wherein the heater is a thermal fuse.

In accordance with some embodiments described herein, there is provided a method of providing an aerosol in an aerosol provision device, the method comprising: providing a heater, providing an aerosol generating medium, heating the heater to a first temperature, wherein the first temperature is suitable for causing the generation of an aerosol from an aerosol generating material, heating a heater to a second temperature, wherein the second temperature is suitable for causing breaking of the heater, wherein the first temperature is lower than the second temperature.

In accordance with some embodiments described herein, there is provided aerosol provision means comprising: aerosol generating means; and a heating means, wherein the heating means are configured in use to supply energy to form an aerosol from the aerosol generating means and wherein the heating means is a thermal fuse means.

DESCRIPTION OF DRAWINGS

The present teachings will now be described by way of example only with reference to the following figures.

Figure 1:
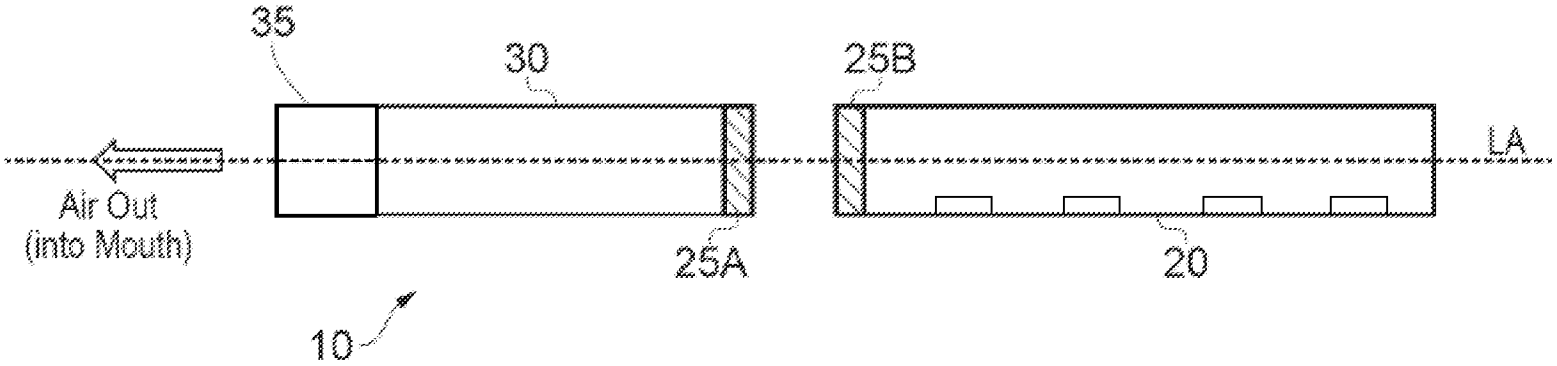
FIG. 1 schematically represents an aerosol delivery device having an uncoupled cartomizer and control unit in cross-section along a longitudinal axis thereof for use in an aerosol delivery system in accordance with an embodiment of the disclosure.

While the invention is susceptible to various modifications and alternative forms, specific embodiments are shown by way of example in the drawings and are herein described in detail. It should be understood, however, that the drawings and detailed description of the specific embodiments are not intended to limit the invention to the particular forms disclosed. On the contrary, the invention covers all modifications, equivalents and alternatives falling within the scope of the present invention as defined by the appended claims.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Throughout the following description the term "e-cigarette" or "electronic cigarette" may sometimes be used, but it will be appreciated this term may be used interchangeably with aerosol provision system/device and electronic aerosol provision system/device. Furthermore, and as is common in the technical field, the terms "aerosol" and "vapor", and related terms such as "vaporize", "volatilize" and "aerosolize", may generally be used interchangeably.

In some embodiments, the non-combustible aerosol provision system is an electronic cigarette, also known as a vaping device or electronic nicotine delivery system (END), although it is noted that the presence of nicotine in the aerosolizable material is not a requirement.

In some embodiments, the non-combustible aerosol provision system is a tobacco heating system, also known as a heat-not-burn system.

In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system.

In some embodiments, the non-combustible aerosol provision device may comprise a power source and a controller. The power source may, for example, be an electric power source.

In some embodiments, the article for use with the non-combustible aerosol provision device may comprise an aerosolizable material, an aerosol generating component, an aerosol generating area, a mouthpiece, and/or an area for receiving aerosolizable material.

In some embodiments, the aerosol generating component is a heater capable of interacting with the aerosolizable material so as to release one or more volatiles from the aerosolizable material to form an aerosol.

In some embodiments, the substance to be delivered may be an aerosolizable material. Aerosolizable material, which also may be referred to herein as aerosol generating material, is material that is capable of generating aerosol, for example when heated, irradiated or energized in any other way. Aerosolizable material may, for example, be in the form of a solid, liquid or gel which may or may not contain nicotine and/or flavorants. In some embodiments, the aerosolizable material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosolizable material may for example comprise from about 50 wt %, 60 wt % or 70 wt % of amorphous solid, to about 90 wt %, 95 wt % or 100 wt % of amorphous solid.

The aerosolizable material may comprise one or more active constituents, one or more carrier constituents and optionally one or more other functional constituents.

The active constituent may comprise one or more physiologically and/or olfactory active constituents which are included in the aerosolizable material in order to achieve a physiological and/or olfactory response in the user. The active constituent may for example be selected from nutraceuticals, nootropics, and psychoactives. The active constituent may be naturally occurring or synthetically obtained. The active constituent may comprise for example nicotine, caffeine, taurine, or any other suitable constituent. The active constituent may comprise a constituent, derivative or extract of tobacco or of another botanical. In some embodiments, the active constituent is a physiologically active constituent and may be selected from nicotine, nicotine salts (e.g. nicotine ditartrate/nicotine bitartrate), nicotine-free tobacco substitutes, other alkaloids such as caffeine.

In some embodiments, the active constituent is an olfactory active constituent and may be selected from a "flavor" and/or "flavorant" which, where local regulations permit, may be used to create a desired taste, aroma or other somatosensorial sensation in a product for adult consumers. In some instances such constituents may be referred to as flavors, flavorants, cooling agents, heating agents, or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional constituents may comprise one or more of pH regulators, coloring agents, preservatives, binders, fillers, stabilizers, and/or antioxidants.

In some embodiments, the article for use with the non-combustible aerosol provision device may comprise aerosolizable material or an area for receiving aerosolizable material. In some embodiments, the article for use with the non-combustible aerosol provision device may comprise a mouthpiece. The area for receiving aerosolizable material may be a storage area for storing aerosolizable material. For example, the storage area may be a reservoir. In some embodiments, the area for receiving aerosolizable material may be separate from, or combined with, an aerosol generating area.

FIG. 1 is a schematic diagram of an aerosol delivery device 10 in accordance with some embodiments of the present disclosure. The aerosol delivery device 10 has a generally cylindrical shape, extending along a longitudinal axis indicated by dashed line LA, and comprises two main components, namely a control unit 20 and a cartomizer 30.

The cartomizer 30 includes an internal chamber containing a reservoir of liquid formulation including nicotine (or more generally a precursor material), a heater (or more generally a vaporizer/atomizer), and a mouthpiece end 35. The cartomizer 30 may further include a wick or similar facility to transport a small amount of the liquid formulation from the reservoir to the heater. The control unit 20 includes a re-chargeable battery as a power supply/source to provide power to the aerosol delivery device 10 and a circuit board for generally controlling the aerosol delivery device 10. When the heater receives power from the battery, as controlled by the circuit board, the heater atomizes (heats) the nicotine and this aerosol (vapor) is then inhaled by a user through the mouthpiece end 35, specifically through one or more openings 352 therein (see FIG. 3).

The control unit 20 and cartomizer 30 are detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the control unit 20 and the cartomizer 30. The electrical connector on the control unit 20 that is used to connect to the cartomizer 30 may also serve as a socket for connecting a charging device (not shown) when the control unit 20 is detached from the cartomizer 30, or alternatively, the control unit 20 may be provided with a dedicated charging port (such as a USB port) at one end thereof, e.g., the end opposite the end configured to couple to the cartomizer 30. The cartomizer 30 may be detached from the control unit 20 and disposed of when the supply of nicotine is exhausted (and replaced with another cartomizer if so desired).

FIG. 1 (and also FIG. 3 described later) represents the mouthpiece end 35 of the cartomizer 30 as a separate box. It should be understood that this representation is not meant to signify that the mouthpiece end 35 is a separate piece/component of the cartomizer 30, but rather a region of the cartomizer 30 which engages with the user's lips when the user desires to inhale aerosol generated by the device 10 with the mouthpiece end 35 of the cartomizer 30 being modified in some way to allow aerosol to pass from inside the cartomizer 30 to outside, e.g., by one or more openings 352. Equally, it should be understood that in alternative implementations the mouthpiece end 35 is provided as a separate component that is attachable to and detectable from the main body of the cartomizer 30. In these alternative implementations, the main body of the cartomizer (which contains the reservoir for storing the aerosol precursor) can be replaced or switched with another main body, e.g., when the reservoir is empty or to change flavors of the aerosol generated. Retaining the mouthpiece end 35 may be advantageous when switching aerosol delivery devices between different users for reasons of hygiene.

Figure 2:
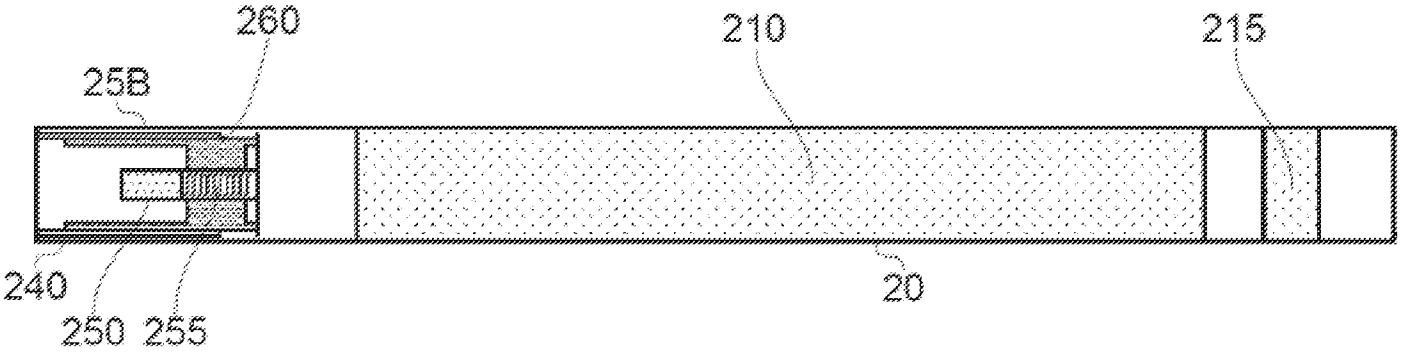
FIG. 2 schematically represents the control unit of FIG. 1 in cross-section along a longitudinal axis thereof.
Figure 3:
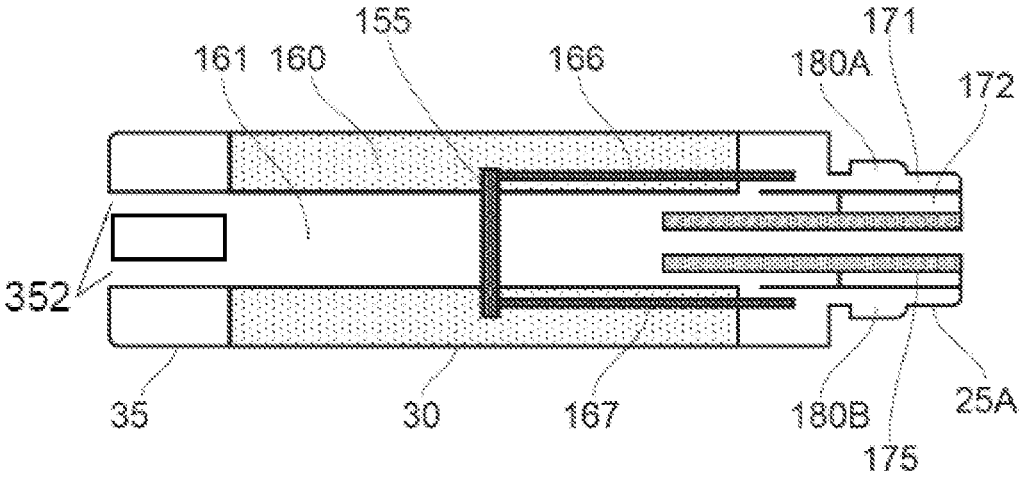
FIG. 3 schematically represents the cartomizer of FIG. 1 in cross-section along a longitudinal axis thereof; and, FIG. 4 schematically represents an arrangement of contacts in an aerosol delivery device according to an example.

FIGS. 2 and 3 provide schematic diagrams of the control unit 20 and cartomizer 30 respectively of the aerosol delivery device of FIG. 1. Note that various components and details, e.g. such as wiring and more complex shaping, have been omitted from FIGS. 2 and 3 for reasons of clarity.

As shown in FIG. 2, the control unit 20 includes, as the power source, a re-chargeable battery or cell 210 for powering the aerosol delivery device 10, as well as a chip, such as a (micro)controller for controlling the aerosol delivery device 10. The controller is attached to a small printed circuit board (PCB) 215 that also includes a sensor unit. If a user inhales on the mouthpiece end 35, air is drawn into the aerosol delivery device 10 through one or more air inlet holes (not shown in FIGS. 1 and 2). The sensor unit detects this airflow, and in response to such a detection, the controller provides power from the battery 210 to the heater 155 in the cartomizer 30.

As shown in FIG. 3, the cartomizer 30 includes an air passage 161 extending along the central (longitudinal) axis of the cartomizer 30 from the mouthpiece end 35 to the connector 25A for joining the cartomizer to the control unit 20. A reservoir 160 for containing an aerosolizable material (for example, a nicotine-containing liquid or another active-containing liquid) is provided around the air passage 161. This reservoir 160 may be implemented, for example, by providing cotton or foam soaked in the liquid. The cartomizer also includes a heater 155, which is described in more detail below, but may take the form of a coil of wire for heating liquid from reservoir 160 to generate aerosol to flow through air passage 161 and out through mouthpiece end 35. The mouthpiece end 35 is provided with two openings 352 fluidly connected to the air passage 161 through which aerosol can be passed to the user's lungs. The heater is powered through lines 166 and 167, which are in turn connected to opposing polarities (positive and negative, or vice versa) of the battery 210 via connector 25A (the details of the wiring between the power lines 166 and 167 and connector 25A are omitted from FIG. 3).

One end of the control unit 20 provides a connector 25B for joining the control unit 20 to the connector 25A of the cartomizer 30. The connectors 25A and 25B provide mechanical and electrical connectivity between the control unit 20 and the cartomizer 30. The connector 25B includes two electrical terminals, an outer electrode 240 and an inner electrode 250, which are separated by insulator 260. The connector 25A likewise includes an inner electrode 175 and an outer electrode 171, separated by insulator 172. The insulator 172 is surrounded by the outer electrode 171. The outer electrodes 171 and 240 and inner electrodes 175 and 250 are formed from an electrically conductive material, such as metal, or are coated/plated with a conductive material (e.g., silver-plated) while the insulators 171 and 260 are formed from a non-conductive material, such as plastic, rubber, silicone, or any other suitable material. When the cartomizer 30 is connected to the control unit 20, the inner electrode 175 and the outer electrode 171 of the cartomizer 30 engage the inner electrode 250 and the outer electrode 240 respectively of the control unit 20. The inner electrode 250 is mounted on a coil spring 255 so that the inner electrode 175 pushes against the inner electrode 250 to compress the coil spring 255, thereby helping to ensure good electrical contact when the cartomizer 30 is connected to the control unit 20.

The cartomizer connector 25A is provided with two lugs or tabs 180A, 180B, which extend in opposite directions away from the longitudinal axis of the cartomizer 30. These tabs 180A, 180B are used to provide a mechanical connection between the cartomizer 30 and the control unit 20. The tabs 180A, 180B in this implementation flexibly engage with corresponding recesses (not shown) in the control unit 20 to provide a snap-fit type engagement to couple the cartomizer 30 to the control unit 20 when the cartomiser 30 is forced toward the control unit 20 along the longitudinal axis LA. In this regard, the tabs 180A, 180B are compressible in a direction towards the longitudinal axis LA to enable the cartomizer 30 to be inserted into the control unit 20 and are shaped so as to resist separation of the cartomizer 30 and control unit 20 when the tabs 180A, 180B are engaged with the corresponding recesses. The snap-fit engagement provides a secure and robust connection between the cartomizer 30 and the control unit 20 so that the cartomizer 30 and control unit 20 are held in a fixed position relative to one another, without wobble or flexing, and the likelihood of any accidental disconnection is very small. Other snap-fit engagement mechanisms may be provided that are constructed in an alternative manner to that described above. Moreover, it will be appreciated that other embodiments may use a different form of connection between the control unit 20 and the cartomizer 30, such as a bayonet or a screw connection.

As mentioned above, the cartomizer 30 is generally disposed of once the liquid reservoir 160 has been depleted, and a new cartomizer is purchased and installed. Alternatively, the cartomizer 30 may be refilled with a new liquid and replaced. In either case the cartomizer 30 is generally removed from the control unit 20.

According to a first aspect of the present disclosure there is provided an article for use with a non-combustible aerosol provision device (herein referred to as a cartomizer). The cartomizer 30 comprises a heater 155 configured in use to supply energy to form an aerosol from an aerosolizable material (herein referred to as an aerosol generating medium), wherein the heater 155 is a thermal fuse.

The combination of the heating functions and the protective fusing functions may be provided by the singular heater component. The heater 155 therefore self-regulates the thermal output provided to the aerosol generating medium. In this way, if there is an anomaly in the supply of power to the heater 155, the heater 155 may fuse and therefore protect against "hot puff" and "dry out". Hot puff may be experienced in the event of a heater 155 overheating and providing the user with hotter than normal aerosol which can be unpleasant to inhale. Dry out can lead to the device heating, and in some cases burning, a wick or the like to provide an unpleasant aroma and taste in the aerosol provided, and may occur when there is little to no liquid adjacent the heater.

Similarly, hot puff and dry out can be experienced when the aerosol generating medium depletes. As the aerosol generating medium depletes, there is a greater amount of thermal energy not absorbed in the aerosolization aerosolisation of the aerosol generating medium and, as such, this excess energy may be contained in the heater and raise the temperature of the heater and then be transferred to the air to be inhaled by the user. This may provide an unpleasant experience for the user as well as possibly damaging the heater by operating above the intended operational temperature for the heater.

The arrangement disclosed herein prevents hot puff and dry out by the heater fuse activating prior to excessive overheating of the heater. The fuse-activation temperature can be set by the user, at least in part by selecting an appropriate heating and fusing feature. For example, the diameter, length, resistivity of a wire may each or all be taken into consideration when designing heating and fusing feature. Other types of heater, such as a diode heater, may have other parameters which may similarly be taken into consideration. In this way, the heater can be selected or designed to fuse at a predetermined temperature to protect against hot puff and dry out occurring during heater operation at, or above, that predetermined temperature.

In an example, the heater may be a diode. A diode is an example of a heater which provides both the heating and fusing functions with a singular element. In an example, the diode provides heat by virtue of the current passing through the diode. The diode may be designed to break during operation at specific voltages or currents. As the heat provided by the diode relates to the current passing through the diode, this breakage acts as a preventative measure against the provision of too great an amount of heat. This, therefore, provides a preventative measure against hot puff and dry out.

In examples, the heater may provide an operational temperature of between about 150° C. to 270° C. This is the temperature at which the heater may at least provide thermal energy to the aerosol generating medium sufficient to generate an aerosol from the medium. This temperature may vary depending on the selection of the aerosol generating medium. The present disclosure provides a heater that will be suitable for working with a large range of aerosol generating media. In other examples, the heater may provide an operational temperature of about 160° C., about 170° C., about 180° C., about 190° C., about 200° C., about 210° C., about 220° C., about 230° C., about 240° C., about 250° C., about 260° C., about 270° C., etc or higher.

Diodes are relatively cheap and therefore can be considered as disposable. The cost of the device containing this heating and fusing solution may be cheaper in comparison to present devices. The cartomizer containing this heater may be provided in a module which can be easily inserted and removed from the aerosol provision device with which it is used. In this way, the bulk of the device, which may be reusable, is reused and the isolated cheap section that is not reusable is discarded after use and subsequently replaced. This arrangement may help extend the lifetime of an aerosol generating device.

In addition, diodes can be designed to have certain characteristics, and as such bespoke diodes having certain heating and fusing characteristics can be manufactured to allow a certain breaking temperature to be achieved. Accordingly, suitable diodes can be manufactured for a wide range of operating conditions. While current commercially available diode technology focusses on a reduction of temperature to increase the electrical efficiency of the diode (i.e., reduce energy losses), diodes may be manufactured that are more efficient at producing heat (i.e., less electrically efficient) such that the above operating temperatures are achievable.

In other implementations, the heater 155 may be made of a material which is designed to break at a desired temperature. For example, fuse wire or the like could well operate in such temperatures, and the skilled person will be aware of other suitable materials that could be used. The exact temperature at which the fuse wire breaks may depend on a number of factors, including the material of the fuse wire.

In a specific example of the cartomizer, the heater may be a light emitting diode (LED). In an example, the diode may be a LED. The LED may enable a visual indication to the user that the heater (which is the LED) is functional and a visual indication as to when the device is operating. If the user initiates a puff session and cannot see the light produced from the LED then the user is informed that the heater is not working, which may be as a result of a safety feature or the like or due to wear and tear. The user is provided with a visual indication that replacement of the cartomizer is required. Therefore, the LED is advantageous in improving user experience of the device.

There may be a transparent, or translucent, section or window between the heater and the outer of the device so that the light generated by the LED, when in use, is able to leave the device easily and be seen easily by the user.

Present diodes may reach the temperatures typically required to provide aerosol from aerosol generating media with standard current and voltage arrangements. In the near future, even greater temperatures are likely to be able to be provided.

Typical e-cigarettes with a liquid and wick arrangement may have heaters which generate temperatures of up to about 150° C. or about 160° C. to produce aerosols. In other examples temperatures of up to about 170° C., about 180° C., about 190° C., about 200° C., about 210° C., about 220° C., about 230° C., about 240° C., about 250° C., about 260° C., about 270° C. etc or higher may be used to produce aerosols. This may be achievable with present diodes or specially designed diodes. The term "heating temperature" and "operational temperature" are used herein to describe a temperature which the heater may reach during operation so as to generate an aerosol from a corresponding aerosol generating medium. This is not necessarily a minimum or a maximum temperature of the heater but rather one that is able to produce an aerosol from an associated aerosol generating medium.

The terms "fusing temperature" or "breaking temperature" are used herein to indicate a temperature at which the heater may break, fuse or otherwise be prevented from continuing to activate. In examples, this temperature may be from around 170° C. to around 270° C. or so. In other examples, this temperature may be about 180° C., about 190° C., about 200° C., about 210° C., about 220° C., about 230° C., about 240° C. about 250° C., about 260° C., about 270° C. etc or higher. In a diode heater, the heater is blown as a result of the circuit being cut from an overload of voltage and current. As voltage and current relate to the temperature of the heater, the corresponding temperature to the voltage and current limit is the temperature above which the heater cannot provide thermal energy, as the heater will break prior to doing so. This may be set by the designer, engineer or user so as to effectively prevent, or largely mitigate against, hot puff or dry out.

In an example of the cartomizer provided herein, the cartomizer may have a second heater. The two heaters may have the same or different operational temperatures. The two heaters may have the same or different fusing temperatures. The two heaters may provide thermal energy to different sections of the aerosol generating medium, to enable a personalized aerosol to be produced. The heaters may be used in tandem (to reduce the usage per puff of each heater and therefore extend the lifetime of the heater) or alternatively.

The device disclosed herein may have a plurality of aerosol generating media within it. The device may have one heater which is dedicated to one aerosol generating medium and one heater dedicated to another aerosol generating medium. In this way, the user can select the desired aerosol for inhalation and the device may activate the corresponding heater for the aerosol generating medium. The heating temperatures of the respective heaters may be set according to the aerosol generating medium with which the heater is to be used. In such a way the heaters can therefore have different operational temperatures. There may be a different total number of aerosol generating media to total number of heaters. The use of multiple heaters operating at different operational temperatures allows the device to bring out different components in the aerosol and therefore provide the user with a bespoke aerosol by focusing on specific compounds as desired by the user.

In the example wherein the device has two heaters, the two heaters may both be diodes, or one may be a diode and one may be a LED, or both may be LEDs. In an example wherein the two heaters are LEDs and are dedicated to different aerosol generating media, the operational temperatures of the LEDs may be different. Alongside this, the LEDs may be made to produce different wavelengths of light such that the user is aware when a specific heater is active. In this way, the user may be informed, in the event that one of the two heaters has failed, which particular heater has failed. The user may then replace that particular heater. This prevents unnecessary replacement of two heaters when only one heater is required to be replaced. This therefore reduces the cost of usage of the device.

The use of two or more heaters allows the device to provide a bespoke heating profile to the aerosol generating medium within the device. The use of two or more heaters also allows the device to provide a bespoke "protection" profile, i.e. a range of temperatures over which specific heaters may break.

In this manner, the use of multiple heaters allows protection at varying temperatures such that greater resilience against a surge in temperature. For example, if one heater is designed to break at 160° C. and one at 170° C., and the heaters are made to operate at 161° C., the first heater will break while the second heater will provide resilience in the device. In this instance, the device therefore can still provide an aerosol from the device. Furthermore, if the aerosol generating media each provide different aerosols, e.g., different flavored aerosols, the user will experience a change in the flavor of the generated aerosol in the event one heater fuses. This can provide a signal to the user that one of the aerosol generating media is running low, for example, and the cartridge requires replacing. Alternatively, or additionally, the volume of the aerosol generated may change in the event that one heater fuses which may also provide a similar indication to the user. This may be the case even if the aerosol generating media provide the same aerosol.

A device may have an equal number of transparent or translucent sections to the number of heaters within the device. In this way, the user is provided with a visual indication of which of the heaters is to be replaced when at least one but not all the heaters have been broken or fused.

The device may have a reservoir or a tank in which a liquid or an aerosol generating medium may be contained. The device may have two or more reservoirs, or may have for example one reservoir and one block of aerosol generating material. The heaters may be arranged suitably to allow thermal energy to transfer efficiently to the liquid or aerosol generating medium. Energy may be provided to the heaters by a power section of the device which may be a battery or the like. An advantage associated with a liquid and wick arrangement relates to a lower heating power being required to provide an aerosol. An advantage associated with a solid aerosol generating medium is that the medium may be cleaner to insert into the device and there is no need for a wick.

Figure 4:
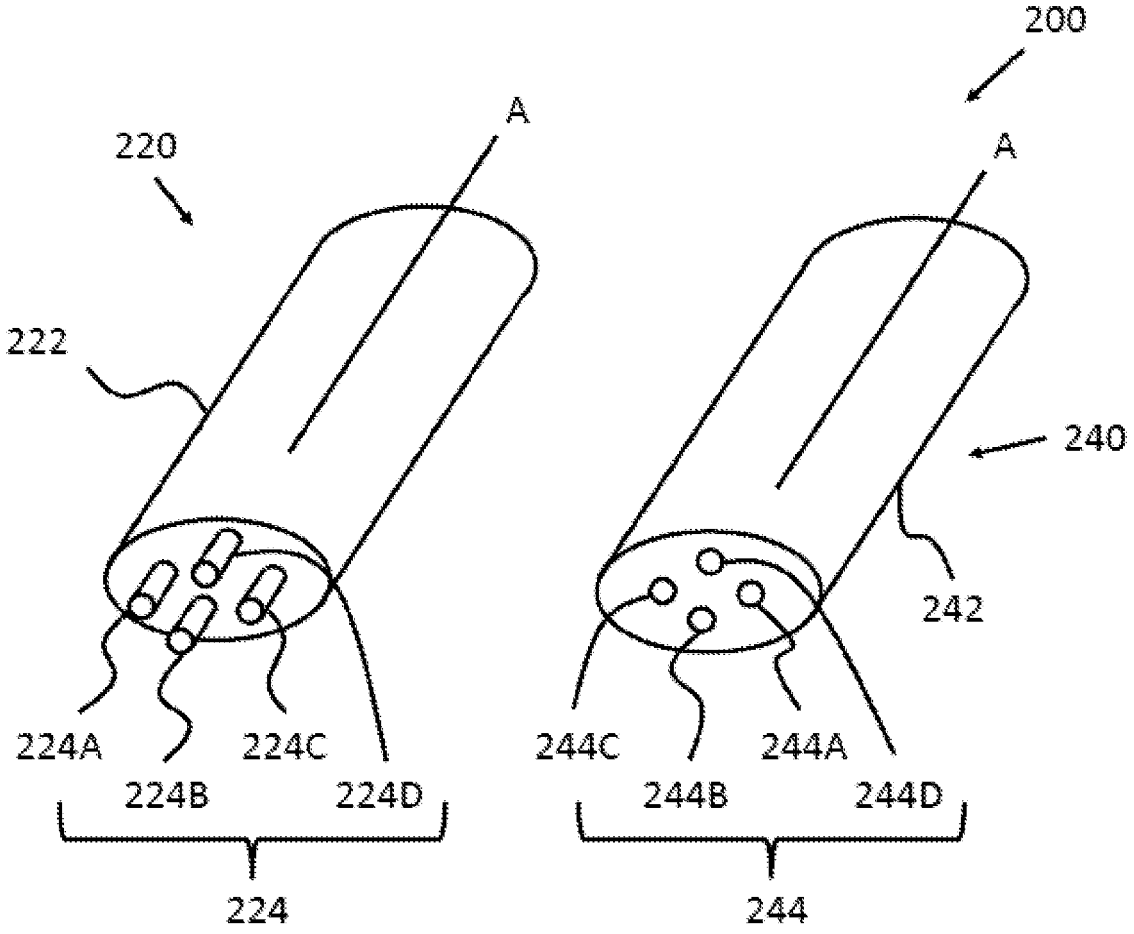

Turning to FIG. 4, in an example of the present disclosure, there is an aerosol provision system or device 200 having a body 220 and a mouthpiece 240 which is arranged to be removable with respect to the body 220. The device 200 may have electrical connections 224A, 224B, 224C, 224D, 244A, 244B, 244C, 244D arranged on the body 220 and mouthpiece 240 having rotational symmetry about a central connection point between the body 220 and the mouthpiece 240 to enable an electrical connection to be made in a plurality of connection orientations.

The connections 224, 244 may have a circular or ovular symmetry. This enables the mouthpiece and the body 220 to be connected in a number of orientations, increasing ease of use of the device for the user. In the specific example shown in FIG. 4, the body 220 of the device 200 may be connected to the mouthpiece 240 in two orientations. The two orientations are 180° apart about the central longitudinal axis A as shown in FIG. 1. Arrangements wherein the device has more connectable orientations between the body 220 and the mouthpiece 240 can be envisaged. For example a square arrangement of the connections 224, 244 in FIG. 4 (alongside use of e.g. a square or circular body 220 and mouthpiece 240), provides 4 orientations in which the mouthpiece 240 can be connected to the body 220.

In the example shown in FIG. 4, the side connections 224A, 224C of the body 220 may be positive body connections 224A, 224C arranged to connect to the corresponding positive mouthpiece connections 244A, 244C. The upper and lower connections 224B, 224D of the body 220 may be the negative body connections 224B, 224D which connect to either of the corresponding negative mouthpiece connections 224B, 244D. In one of the two orientations in which the body 220 can be connected to the mouthpiece 240, the left positive body connection 224A of FIG. 1 connects to the left negative mouthpiece connection 244A. Correspondingly, the right positive body connection 224C of FIG. 1 connects to the right negative mouthpiece connection 244C. In the other of the two orientations in which the body 220 can be connected to the mouthpiece 240 the left negative body connection 224A of FIG. 1 connects to the right negative mouthpiece connection 244C (and vice versa).

The mouthpiece 240 may have an outlet through which the aerosol generated in the device 200 may pass to be inhaled by a user. The device 200 may have a number of sections alongside or within the body 220 and mouthpiece 240. A modular arrangement advantageously allows the user to discard only the section requiring of being discarded and reusing sections that do not require discarding. In a specific example this refers to the discardable cartomizer while retaining, for example, the mouthpiece and the power section which may contain a battery or the like. The modular nature of the device is therefore advantageous at least in this manner.

Thus there has been described an aerosol provision system comprising: an aerosol generating medium reservoir; and, a cartomizer comprising a heater, the heater configured in use to supply energy to form an aerosol from an aerosol generating medium in the aerosol generating medium reservoir and wherein the heater is a thermal fuse.

The aerosol provision system may be used in a tobacco industry product, for example a non-combustible aerosol provision system.

In one embodiment, the tobacco industry product comprises one or more components of a non-combustible aerosol provision system, such as a heater and an aerosolizable substrate.

In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in or on a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material, and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise an aerosol or aerosol generating agent or a humectant, such as glycerol, propylene glycol, triacetin or diethylene glycol.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, the entirety of this disclosure shows by way of illustration various embodiments in which the claimed invention(s) may be practiced and provide for a superior electronic aerosol provision system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A consumable for an aerosol provision system, the consumable comprising:

a heater configured in use to supply energy to form an aerosol from an aerosol generating medium, wherein the heater is a thermal fuse and wherein the heater is a diode, wherein the heater is made of a fuse wire designed to break at a desired temperature;

wherein the thermal fuse is configured to break at a temperature of from about 160° C. to about 270° C.

2. The consumable according to claim 1, wherein the diode is a light emitting diode.

3. The consumable according to claim 1, wherein in use the heater reaches a heating temperature of at least about 150° C.

4. The consumable according to claim 1, comprising at least one further heater, wherein the heater and the at least one further heater are arranged in use to supply energy to form the aerosol from different portions of the aerosol generating medium.

5. The consumable according to claim 4, wherein the heater has a first heating temperature and is configured to break at a first fuse temperature and the at least one further heater has a second heating temperature and is configured to break at a second fuse temperature, wherein the first heating temperature is different to the second heating temperature and the first fuse temperature is different to the second fuse temperature.

6. An aerosol provision system comprising:

an aerosol generating medium; and, a heater, the heater configured in use to supply energy to form an aerosol from the aerosol generating medium and wherein the heater is a thermal fuse configured to break at a temperature of from about 160° C. to about 270° C. and wherein the heater is a diode made of a fuse wire designed to break at a desired temperature.

7. The aerosol provision system according to claim 6, wherein the diode is a light emitting diode.

8. The aerosol provision system according to claim 6, further comprising a body;

a mouthpiece arranged to be removable with respect to the body; and, electrical connections arranged on the body and mouthpiece having rotational symmetry about a central connection point between the body and the mouthpiece to enable an electrical connection to be made in a plurality of connection orientations.

9. The aerosol provision system according to claim 6, wherein the aerosol generating medium comprises a liquid aerosol generating medium.

10. The aerosol provision system according to claim 6, wherein the aerosol generating medium comprises a solid aerosol generating medium.

11. A method of providing an aerosol in an aerosol provision device, the method comprising:

providing a heater wherein the heater is a thermal fuse and wherein the heater is a diode and wherein the heater is made of a fuse wire designed to break at a desired temperature, providing an aerosol generating medium, heating the heater to a first temperature, wherein the first temperature is suitable for causing the generation of the aerosol from the aerosol generating material, heating the heater to a second temperature, wherein the second temperature is suitable for causing breaking of the heater, wherein the first temperature is lower than the second temperature, wherein the thermal fuse is configured to break at a temperature of from about 150° C. to about 200° C.

12. Aerosol provision means comprising:

aerosol generating means; and a heating means, wherein the heating means are configured in use to supply energy to form an aerosol from the aerosol generating means and wherein the heating means is a thermal fuse means, and wherein the heating means is a diode made of a fuse wire designed to break at a desired temperature configured to break at a temperature of from about 160° C. to about 270° C.

* * * * *